United States Patent [19]

Larsen

[11] Patent Number: 5,074,506

[45] Date of Patent: Dec. 24, 1991

[54] COLLAPSIBLE ARTICLE HOLDER FOR BOATS

[76] Inventor: Per F. Larsen, 87 Bishop La., Madison, Conn. 06443

[21] Appl. No.: 291,589

[22] Filed: Dec. 29, 1988

Related U.S. Application Data

[63] Continuation-in-part of Ser. No. 202,411, Jun. 6, 1988, abandoned.

[51] Int. Cl.[5] ..... A47F 7/00

[52] U.S. Cl. ..... 248/309.1; 248/284; 248/311.2; 403/99

[58] Field of Search ..... 248/309.1, 284, 291, 248/311.2, 314, 296, 218.4, 312.1, 124, 125, 201, 121, 153, 311.3, 230; 403/99, 102; 114/219

[56] References Cited

U.S. PATENT DOCUMENTS

| | | | |
|---|---|---|---|
| 473,781 | 4/1892 | Reed et al. | 248/296 |
| 480,280 | 8/1892 | Rochlitz | 248/296 |
| 587,151 | 7/1897 | Lavercombe | 248/296 X |
| 1,079,192 | 11/1913 | Sowden | 248/311.2 |
| 1,289,830 | 12/1918 | Leimecke . | |
| 1,748,005 | 2/1930 | Vlavianos | 403/99 |
| 1,809,317 | 6/1931 | Snyder . | |
| 2,113,153 | 4/1938 | Jonassen . | |
| 2,279,442 | 4/1942 | Burns et al. | 248/311.2 |
| 2,754,078 | 7/1956 | Koger et al. | 248/311.2 |
| 2,791,392 | 5/1957 | Black . | |
| 2,892,548 | 6/1959 | Huff . | |
| 3,391,891 | 7/1968 | Garden | 248/311.2 |
| 3,547,054 | 12/1970 | Caldwell | 403/99 X |
| 3,689,016 | 9/1972 | Hammon . | |
| 3,734,439 | 5/1973 | Wintz . | |
| 3,991,961 | 11/1976 | Platzer, Jr. | 248/291 X |
| 4,063,701 | 12/1977 | Wray . | |
| 4,141,665 | 2/1979 | Snapp, Jr. | 403/102 X |
| 4,174,086 | 11/1979 | Verberkmoes | 248/291 X |
| 4,290,529 | 9/1981 | Jones et al. | 248/311.2 X |
| 4,434,961 | 3/1984 | Hoye | 248/311.2 |
| 4,526,124 | 6/1985 | Hartwall . | |
| 4,624,374 | 11/1986 | Murtaugh | 248/230 X |
| 4,673,148 | 6/1987 | Oliver | 248/309.1 X |
| 4,773,348 | 9/1988 | Rowley | 248/311.2 |

*Primary Examiner*—Karen J. Chotkowski
*Attorney, Agent, or Firm*—Robert H. Montgomery

[57] ABSTRACT

A holder for boat fenders and other objects where the boat has upright stanchions for supporting a life line or upper railing comprising first and second hoop members adapted to be pivotally mounted to a stanchion at vertically spaced apart upper and lower locations, with hoop member at the lower location adapted to provide lower support for a fender and at least partially encircle the fender, the upper hoop member encircling the fender in an operative position, both of the hoop members adapted to reside in a vertical position when not supporting a fender. The holder may further include first and second vertically positioned strap members pivotally connected to the hoop members at vertically spaced apart locations and at substantially diametrically spaced apart locations on the hoop members, and means is provided for attaching one of the strap members to a stanchion.

14 Claims, 3 Drawing Sheets

COLLAPSIBLE ARTICLE HOLDER FOR BOATS

RELATED APPLICATION

This application is a continuation-in-part of application Ser. No. 202,411 filed June 6, 1988 which is now abandoned.

FIELD OF THE INVENTION

This invention relates to a holder for boat fenders and other objects.

BACKGROUND THE INVENTION

Fenders which generally comprise cylindrical resilient members which are vertically elongated and have a partially spherical bottom are used on boats to prevent the scrapping of the hull of the boat on pilings or docks or other boats when two or more boats are tied together. Such fenders are generally stowed under the seats in the cockpit of a sailboat and are utilized when the boat is docked by tying the fenders through a line to stanchions or the life line of a sail boat. In the case of power boats which may also have seats in the cockpit or towards the stern, the fenders in many cases are stored under hinged tops of the seats.

In some cases, fender holders have been utilized which are of a rigid nature and secured to the railing of a pulpit in power boats. Such fender holders generally comprise rod stock which is bent to conform to the shape of the fenders and then have hoops attached thereto to receive the fenders therein. In some cases cloth fender holders have been secured to the railing of the pulpit of the boat to receive fenders therein for storage.

However, such fender storage devices extend inwardly of the railing of a boat and may block free access for someone moving from stern to bow or vice versa. Accordingly the present invention provides new and improved fender holders which may be collapsed when fenders or other objects are not stored therein and be very unobtrusive. Alternatively, the equipment fender or other equipment holders of this invention may be mounted to a stanchion on the boat outboard thereof to receive other equipment such as bait buckets.

SUMMARY OF THE INVENTION

Briefly stated, the invention in one form thereof, comprises a holder for boat fenders where the boat has upright stanchions for supporting a life line or upper railing, and comprises first and second hoop members adapted to be pivotally mounted to the stanchion at vertically spaced apart upper and lower locations, the hoop member at the lower location being adapted to provide lower support for the fender and at least partially encircle the fender, the upper hoop member encircles the fender in an operative position, and both of the hoop members are adapted to reside in a vertical position when not supporting a fender. In one embodiment of the invention, the hoop members are individually supported on a stanchion and attached to the stanchion in a manner which enables them to be fixed in a horizontal position to support a fender or to be collapsed to a vertical position. The invention in another preferred form further includes first and second vertically positioned strap members pivotally connected to the hoop members at vertically spaced apart locations and at substantially diametrically spaced apart locations on the hoop members, and means are provided for attaching one of the strap members to a stanchion.

An object of this invention is to provide a new and improved boat fender holder and holder of other objects.

Another object of this invention is to provide a boat fender holder of improved design which collapses to a vertical position when not stowing a fender.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED OF PREFERRED EMBODIMENT OF THE INVENTION

Figure 3:
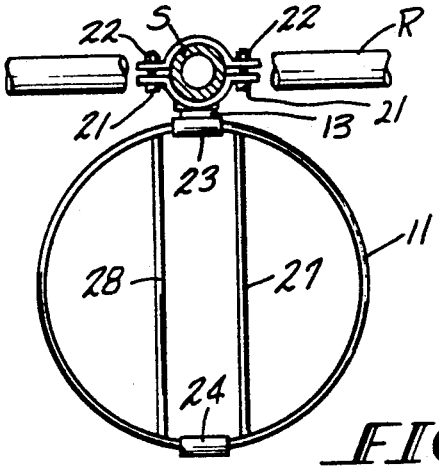
FIG. 3 is a view seen in the plane of lines 3—3 of FIG. 1.
Figure 1:
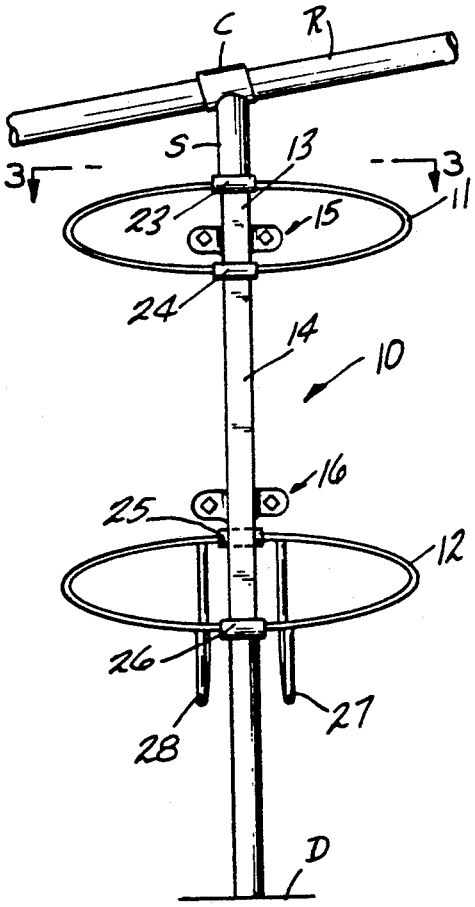
FIG. 1 is a front view in perspective of apparatus embodying invention in an extended position.
Figure 2:
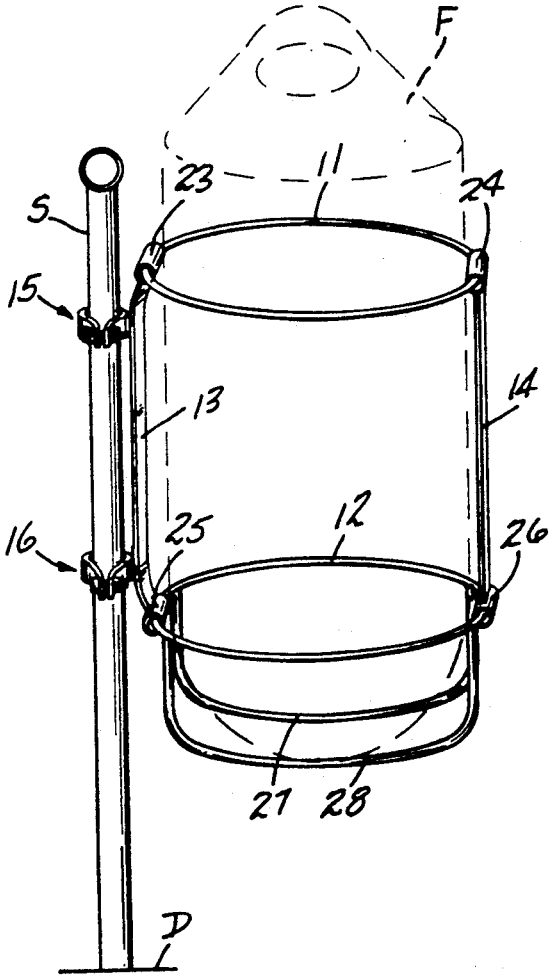
FIG. 2 is a view seen from the left side of FIG. 1 in perspective.

As shown in FIGS. 1 and 2, apparatus embodying the invention is affixed to a stanchion S extending from the deck of a boat and having a collar C at the upper portion thereof which receives a rail R. The apparatus 10 comprises an upper hoop 11 and a lower hoop 12 which are pivotally connected to straps 13 and 14 as hereinafter described. Strap 13 has upper and lower clamping members 15 and 16, respectively, thereon. As shown more clearly in FIGS. 3 and 4, the clamping members comprise two semi-circular portions 17 and 18 having flanges 19 and 20 extending therefrom adapted to receive fastening elements in the form of bolts 21, which extends into a nut or other receiving member on member 18. In this manner, the strap 13 is affixed to the stanchion S at upper and lower portions, as most clearly exemplified in FIG. 3. Affixed to the upper end of straps 13 and 14 are sleeves 23 and 24, respectively, which receive hoop 11 therein. Similarly, affixed to the lower end of straps 13 and 14 are sleeves 25 and 26, which received hoop 12 therein. Affixed to lower hoop 12 are two bottom support members 27 and 28 which are so spaced that they will be on either side of stanchion S.

Figure 5:
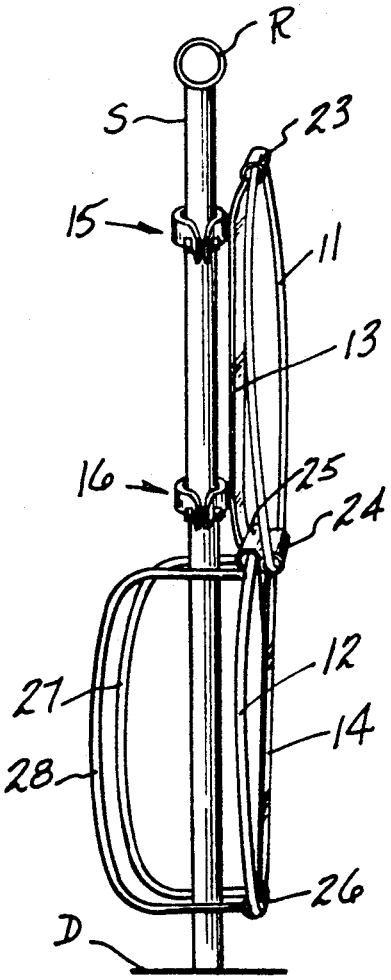
FIG. 5 is a side view of the device of FIGS. 1 and 2 in perspective in a folded condition.

Shown in broken line in FIG. 2 is a boat fender F which is received within hoops 11 and 12 and rests on bottom support members 27 and 28. When an article, such as a fender or perhaps a bait bucket, is inserted into the device, such article will hold the apparatus in an extended condition, as shown in FIG. 2. However, when such article is removed, the apparatus will pivotally fold to a position as shown in FIG. 5, under influence of its own weight and gravity and is very unobtrusive on the superstructure.

The device as shown is arranged to be mounted to or demounted from a stanchion. However if it is so desired, the clamps 15 and 16 could be replaced with circular members that are permanently pinned or otherwise fastened to the stanchion S. The device folds or stows to a downward vertical position that is unobtrusive and takes very little deck space. The device may be mounted on the stanchion to either be inboard or outboard of the rail R.

In a more simple embodiment of the invention, the two hoops 11 and 12 could be individually pivoted to clamp members 15 and 16. In this arrangement the lower hoop would be made of a slightly smaller diameter than the fender to receive the lower partially spherical bottom of the fender.

Figure 4:
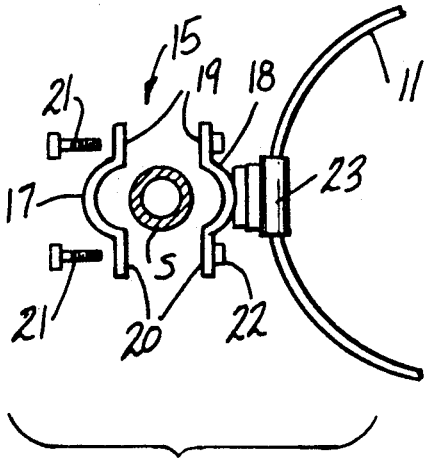
FIG. 4 is an exploded view of a portion of FIG. 3.
Figure 6:
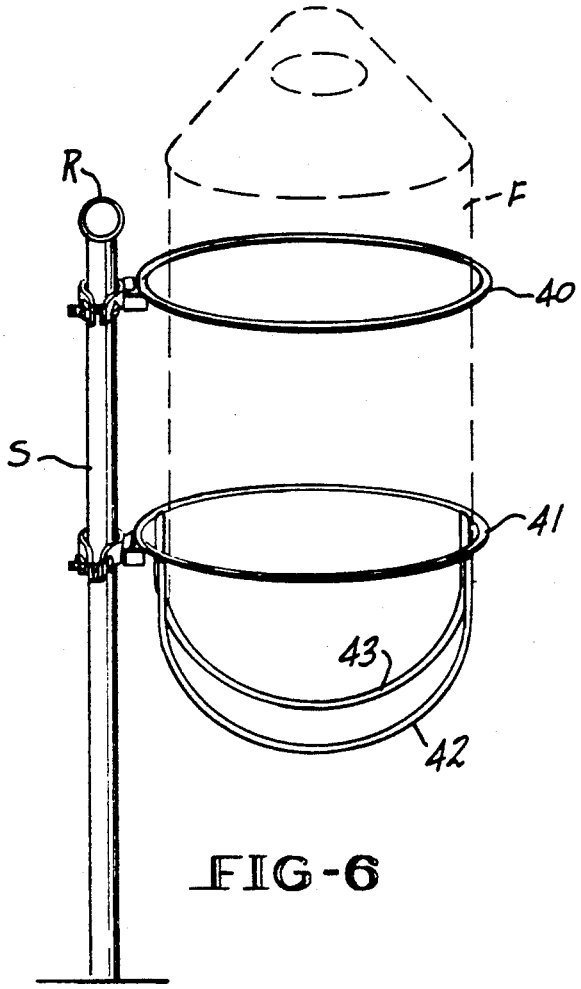
FIG. 6 is a side view in perspective of another embodiment of the invention as mounted to the stanchion of a boat showing the fender holder in an operative position.

FIG. 6 shows a stanchion S on a boat having an upper retaining member 40 and a lower supporting member 41, individually attached. Stanchion S supports a rail R at the upper end thereof. Attachment is made to the stanchion S as shown in FIG. 4 and previously described in conjunction therewith. As shown in FIG. 6, members 40 and 41 are in operative position to support a fender F shown in broken line. Support member 41 has two lower support members 42 and 43 of generally arcuate shape but they are on either side of stanchion S and the bottom of the fender F is vertically supported thereon.

Figure 7:
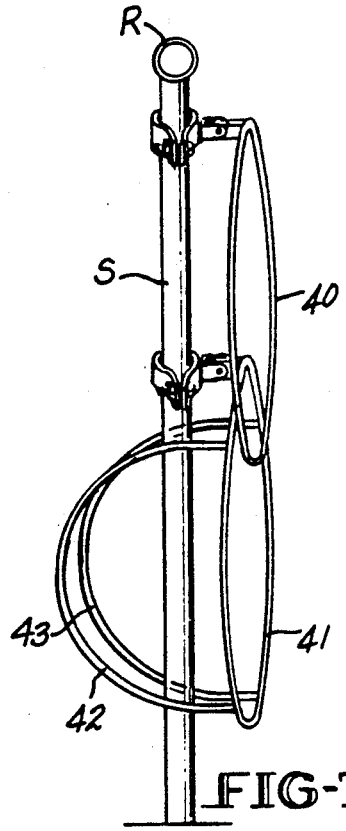
FIG. 7 is a view similar to FIG. 6 but showing the fender holders in a collapsed position.

FIG. 7 shows the fender holder 40 and support 41 in a collapsed position when the fender F is removed.

Figure 8:
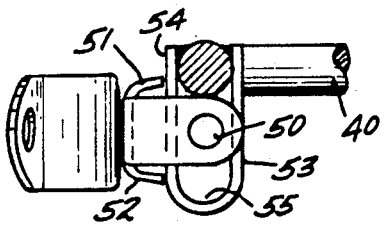
FIG. 8 is a side view of a portion of the apparatus of FIG. 6 when the invention is in a fender holding position.
Figure 11:
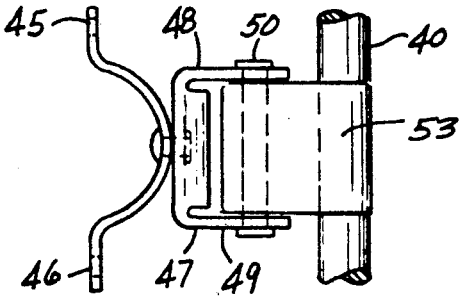
FIG. 11 is a top view of the apparatus of FIG. 10.
Figure 9:
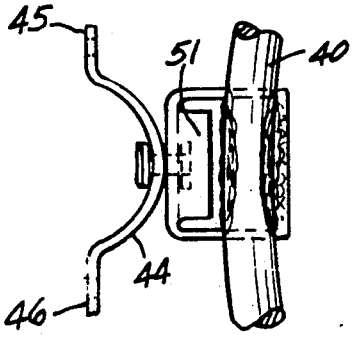
FIG. 9 is a top view of the mechanism of FIG. 8.

Reference is now made to FIGS. 8 and 9 which show a semi-circular clamp member 44 having flanges 45 and 46 adapted to be attached to a mating member about stanchion S. Pivotally attached to member 44 as by means of a pin or a rivet is a generally U-shaped bracket 47 having spaced apart arms 48 and 49 which carry a pin or shaft 50 therebetween. Member 47 also has upper and lower ears 51 and 52. Member 40 is attached to a vertically disposed (as shown in FIG. 8) elongated U-shaped bracket 53 which receives pin 50 therein. Thus, bracket 53 may move vertically with respect to pin 50 and may pivot thereabout, as will hereinafter be described. Both retainer 40 and support 41 are attached to stanchion S as described herein.

As shown in FIGS. 8 and 9, the supports 40 and 41 are in an operative position to receive a fender F. Pin 50 is within bracket 53 and in a position where the ears 51 and 52 bear on a leg 54 of bracket 53. With this arrangement, retainer 40 will be in a horizontal position as shown in FIG. 6 and the ears 51 and 52 will retain it in such horizontal position.

Figure 10:
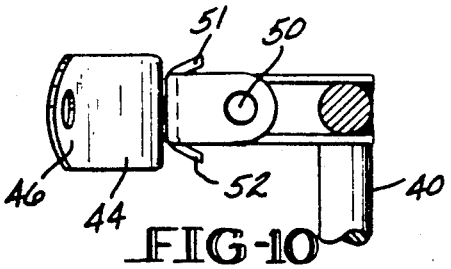
FIG. 10 is a side elevation of a portion of the apparatus embodying the invention as shown in FIG. 7.

If it is desired to collapse the fender holder, the member 40 will be raised until pin 50 is at the bight portion 55 of U-shaped bracket 53, at which time the bracket 53 is pivoted about pin 50 to the position shown in FIG. 10. In this position, the retaining ring 40 hangs in a vertical position as exemplified in FIG. 7. In the position shown in FIG. 7, the bottom support members 42 and 43 of support member 41 are disposed on either side of the stanchion S.

If desired, the lower support member 41 could be made of smaller diameter so that the bottom of the fender F would be partially received therein. This is assuming that the fender is of the type having a generally hemispherical bottom.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A holder for boat fenders, adapted to be mounted to a boat where the boat has upright stanchions for supporting a life line or upper railing comprising upper and lower hoop members adapted to be pivotally mounted to a stanchion at vertically spaced apart upper and lower locations, mounting means for pivotally mounting each of said hoop members to a stanchion, said lower hoop member adapted to provide lower support for a fender when in a generally horizontal position and at least partially encircle a fender, said upper hoop member encircling the fender in a generally horizontal position, both of said hoop members being pivotal on said mounting means from a generally horizontal fender holding position to a downwardly directed vertical position below the life line or railing when not supporting a fender.

2. The holder of claim 1 where said mounting means comprises first and second vertically positioned strap members pivotally connected to said hoop members at vertically spaced apart locations and at substantially diametrically spaced apart locations on said hoop members, and said mounting means includes means for attaching one of said strap members to a stanchion.

3. The holder of claim 2 further including means on said lower hoop member for supporting a fender therein from the bottom of the fender.

4. The holder of claim 1 further including vertically extending members pivotally connected to said hoops.

5. The holder of claim 1 where said upper and lower hoop members are individually pivoted to the stanchion and said lower hoop member has supporting means generally perpendicular to said lower hoop member to support the bottom of a fender received therein, said supporting members residing on either side of a stanchion when said hoops are in a downwardly directed position.

6. The holder of claim 5 where said supporting means comprises two lower supporting members positioned so as to reside on either side of a stanchion when said hoop is in a downwardly directed vertical position.

7. The holder of claim 1 where each of said hoop members are mounted to an elongated U-shaped bracket member having a bight, each of said mounting means carrying a pin which is received in one of said bracket members on each of said mounting means for engaging said U-shaped bracket members and holding said hoop members in a horizontal position, said hoop members being pivotal to a downwardly directed vertical position when said U-shaped bracket members are moved vertically to receive said pins in the bight of said U-shaped bracket members.

8. The holder of claim 1 wherein each of said hoop members are mounted to a bracket member which is attached to the stanchions at said upper and lower spaced apart locations, each of said bracket members including means for supporting a hoop member in a generally horizontal position.

9. The holder of claim 8 further including lower supporting members affixed to said lower hoop member and generally perpendicular to the plane of said lower hoop member.

10. The holder of claim 9 where said lower supporting members are two in number and positioned so as to reside on either side of a stanchion when said lower hoop member is in a downwardly directed vertical position.

11. The holder of claim 8 where each of said bracket members comprises an elongated U-shaped bracket member having a bight between two legs thereof which is substantially parallel to the axis of said attachment means, attachment means including a shaft received within said U-shaped bracket member, means on said attachment means for engaging a U-shaped bracket member and holding a hoop member in a horizontal position, said hoop members being pivotal to a vertical position when said U-shaped bracket members are moved vertically to receive said shafts in the bights of said U-shaped brackets.

12. The holder of claim 8 where said shafts are mounted in said bracket members which pivotally mounts to said attachment means.

13. A holder for boat fenders adapted to be mounted to a boat where the boat has upright stanchions for supporting a life line or upper railing comprising upper and lower hoop members adapted to be pivotally mounted to a stanchion at vertically spaced apart upper and lower locations, means for mounting each of said hoop members to a stanchion, each of said mounting means having means pivotally supporting one of said hoop members, said lower hoop members having bottom support means for a fender, said hoop members when in a generally horizontal position at least partially encircling the fender, both of said hoop members being pivotal to a downwardly directed vertical position generally perpendicular to the horizontal position, said hoop members being mounted to an elongated U-shaped bracket member having a bight, each of said mounting means including a pin which is received in a respective one of said U-shaped brackets members, ear means on each of said mounting means for engaging said U-shaped bracket members when said hoop members are in a generally horizontal position, said hoop members being pivotal to a downwardly directed vertical position wherein said U-shaped bracket members are moved vertically for disengagement with the ear means and said pins are disposed in the bight of said U-shaped bracket members.

14. The holder of claim 13 where said upper and lower hoop members are individually pivoted to the stanchion and said lower hoop member has supporting members generally perpendicular to said lower hoop member to support the bottom of a fender received therein, said supporting members residing on either side of a stanchion when said hoops are in a downwardly directed position.

* * * * *